United States Patent [19]

Iwami

[11] Patent Number: 4,813,249

[45] Date of Patent: Mar. 21, 1989

[54] SQUEEZING DEVICE

[75] Inventor: Hideo Iwami, Kyoto, Japan

[73] Assignee: Naigai Special Dyeing Co., Ltd., Kyoto, Japan

[21] Appl. No.: 115,605

[22] Filed: Oct. 29, 1987

[30] Foreign Application Priority Data

Mar. 3, 1987 [JP] Japan ..... 62-031758[U]

[51] Int. Cl.[4] ..... B30B 3/04; D06B 15/02

[52] U.S. Cl. ..... 68/244; 29/116.2; 100/162.2; 100/162 B

[58] Field of Search ..... 68/22 R, 244; 100/162 B; 29/116 AD

[56] References Cited

U.S. PATENT DOCUMENTS 4,090,282 5/1978 Lehmann ..... 29/116 AD
4,198,905 4/1980 Lehmann ..... 100/162 B
4,246,668 1/1981 Spillmann et al. ..... 68/22 R X

FOREIGN PATENT DOCUMENTS 1036199 8/1958 Fed. Rep. of Germany ..... 68/244
197706 6/1977 U.S.S.R. ..... 29/116 AD

*Primary Examiner*—Philip R. Coe
*Attorney, Agent, or Firm*—Lowe, Price, LeBlanc, Becker & Shur

[57] ABSTRACT

A squeezing device includes a driving squeezing extractor and a driven squeezing extractor which comes rotationally in contact with the driving squeezing extractor to carry out a squeezing process on a fabric to be dyed by feeding of the fabric through between the two squeezing extractors, the driven squeezing extractor being composed of a hollow cylindrical rotatable member which is rotatably supported on a center shaft inserted along the axis thereof, and a plurality disc-like supporting members which are arranged inside the cylindrical rotatable member, and each of the disc-like supporting members on the ends is rotatably fitted with an inner periphery of the cylindrical rotatable member and is movable relative to the center shaft in the axial direction.

3 Claims, 5 Drawing Sheets

SQUEEZING DEVICE

BACKGROUND OF THE INVENTION

1. Field of the Invention

The present invention relates to a squeezing device for use in squeezing of dye liquor when carrying out full width continuous dyeing of a fabric, for example.

2. Description of Prior Art

One of the devices conventionally used in the squeezing process comprises an elongated driving squeezing extractor which is rotated by a drive source such as a motor, and a driven squeezing extractor having substantially the same length as said driving squeezing extractor and which comes rotationally in contact with the driving squeezing extractor, and wherein a fabric to be dyed is continuously fed through between these two extractors so that a dye liquor impregnated into the fabric is squeezed out while being pressed between the extractors.

The extractors are usually made of steel, but since they are elongated components and a considerable pressure is applied thereto when a fabric is pressed therebetween, it is unavoidable that a deflection occurs in the driven squeezing extractor 2 in relation to the driving squeezing extractor 1, as shown in FIG. 12 and FIG. 13, thereby generating a problem of irregular concentration of liquor in the middle part of the fabric to be processed as compared with both side parts thereof. That is, as shown in FIG. 12, when the middle part of the driven squeezing extractor 2 is deflected in a direction of being strongly pressed against the driving squeezing extractor 1, the middle part of the fabric is strongly squeezed and comes to present a lighter color tone, in other words, a so-called listing takes place. On the other hand, when the middle part of the driven squeezing extractor 2 is deflected in a direction going away from the driving squeezing extractor 1, forming a gap between the middle portions of the two extractors 1, 2, the middle part of the fabric comes to be deeply dyed, in other words, a so-called light and shade takes place. Thus, there arises a problem of poor dyeing quality, a solution to which has been desired to be solved for a long time.

SUMMARY OF THE INVENTION

The present invention was made to solve the above-discussed problem and has an object of providing a squeezing device comprising a correction mechanism which meets the deflection of a driven squeezing extractor in such a manner that a front face of a driven squeezing extractor comes in contact with a driving squeezing extractor with even pressure therebetween.

To accomplish the foregoing object, there is provided a squeezing device according to the invention comprising a driving squeezing extractor and a driven squeezing extractor which comes rotationally in contact with the driving squeezing extractor to carry out a squeezing process on a fabric to be dyed by feeding the fabric through between the two squeezing extractors, characterized in that said driven squeezing extractor comprises a hollow cylindrical rotatable member which is rotatably supported on a center shaft inserted through along the axis of the cylindrical rotatable member, and disc-like supporting members which are arranged inside the cylindrical rotatable member being respectively located at least on both ends in the axial direction of said cylindrical rotatable member, each of said disc-like supporting members on the ends being rotatably fitted with an inner periphery of said cylindrical rotatable member and movable relative to said center shaft in the axial direction thereof.

According to a squeezing device of the above described construction, when the middle portion of the driven squeezing extractor is deflected in a direction of being strongly pressed against the driving squeezing extractor, the disc-like supporting members are respectively moved to both ends of the cylindrical rotatable member.

Accordingly, a supporting force acts on both ends of the driven squeezing extractor from inside toward the driving squeezing extractor by the respective disc-like supporting members located on both ends, while a stress going away from the driving squeezing extractor acts on the middle portion of the driven squeezing extractor, thereby the deflection on the part of the driven squeezing extractor being is corrected and the full length of the driven squeezing extractor comes to evenly act on the driving squeezing extractor. On the other hand, when the middle portion of the driven squeezing roller is deflected in a direction going away from the driving squeezing extractor, i.e., in a direction opposite to that defining the preceding case, then the disc-like supporting members from both ends are moved to the middle part of the cylindrical rotatable member. In this manner, a supporting force acts on the middle portion of the driven squeezing extractor from inside toward the driving squeezing roller by the disc-like supporting members, whereby the full length of the driven squeezing extractor comes to evenly act on the driving squeezing extractor without deflection. As a result, a squeezing process of high quality without uneven pressure or consequential irregular concentration of liquor in the fabric can be performed.

Other objects and features of the invention will become apparent in the course of the following description when the same is considered with the accompanying drawings.

BRIEF DESCRIPTION OF THE DRAWINGS

FIG. 1 is a longitudinal sectional view of a driven squeezing extractor;

FIG. 2 and FIG. 3 are sectional views respectively taken along the line II—II and the line III—III in FIG. 1;

FIG. 4 is a partially perspective view of a cylindrical rotatable member;

FIG. 5 is a partially developed view of the cylindrical member of FIG. 4;

FIG. 6 to FIG. 8 are views illustrating several stages of operation corresponding to turning the center shaft by 90° and 180°, respectively;

FIG. 9 to FIG. 11 are transverse sectional views at line II—II of FIG. 1, illustrating several stages of operation when turning a planetary gear by 90° and 180°.

DESCRIPTION OF THE PREFERRED EMBODIMENT

A preferred embodiment of the present invention is described hereinafter with reference to the accompanying drawings.

Figure 1:
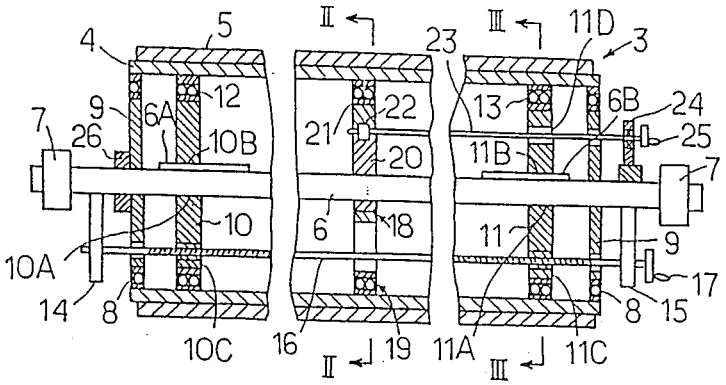
FIG. 1 to FIG. 11 illustrates an embodiment of the squeezing device according to the present invention, and therein.
Figure 2:
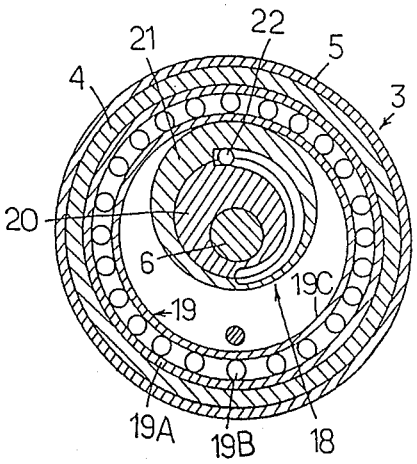
Figure 3:
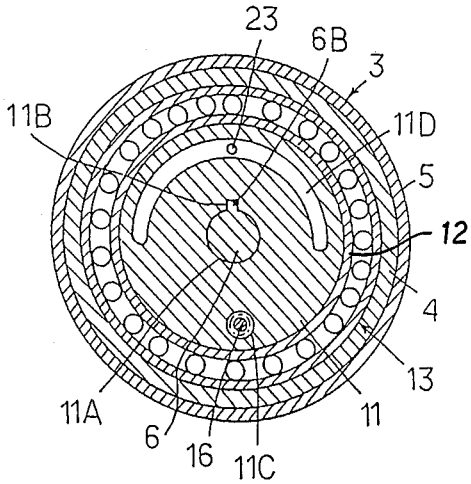

In FIG. 1 illustrates a longitudinal sectional view of a driven squeezing extractor 3 in a preferred embodiment of the invention and FIGS. 2 and 3 illustrate sectional views taken along the lines II—II and III—III respectively in FIG. 1, A elongated hollow cylindrical rotatable member 4 has on its outside rubber layer 5, composed of laminated rubbers externally fitted on an outer periphery of the cylindrical rotatable member 4 to give the rubber a certain elasticity and hardness. A center shaft 6 passes through the axis of the cylindrical rotatable member 4, and has ends respectively supported on bearings 7. The center shaft 6 is inserted through side plate members 9 each attached like a cap to openings on both ends of the cylindrical rotatable member 4 through bearings 8. The side plate members 9 are fixed to the center shaft 6 by couplings 26. In this manner, the cylindrical rotatable member 4 is rotatably supported on the center shaft 6 at a specified position through the bearings 8 and the side plate members 9.

Disc-like supporting members 10, 11 are rotatably fitted on both ends of the internal part of the cylindrical rotatable member 4 through annular bearings 12, 13 which are externally fitted on the disc-like supporting members 10, 11. The center shaft 6 is inserted through inserting holes 10A, 11A in the center of the two supporting members 10, 11. Keys 6A, 6B of the center shaft 6 are respectively seated on key ways 10B, 11B provided on the holes 10A, 11A so as to rotate together with the center shaft 6. The keys 6A, 6B can be freely moved horizontally along the center shaft 6. Tapped holes 10C, 11C are respectively formed on the portions near peripheral edges of the disc-like supporting members 10, 11, and a screw-threaded rod 16 is engagedly inserted in the cylindrical rotatable member 4 therethrough. The ends of the screw-threaded rod 16 are supported on bearings 14, 15. Thread grooves in opposite direction to each other are formed on the rod 16 at positions corresponding to each of the supporting members 10, 11, so that the two supporting members 10, 11 are moved either in a direction moving away from each other or in a direction coming near to each other upon appropriate rotation of rod 16.

Figure 4:
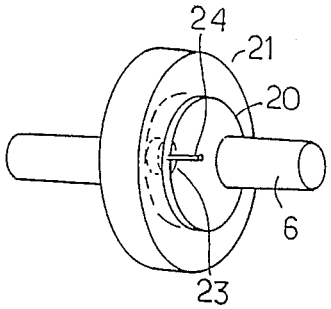
Figure 5:
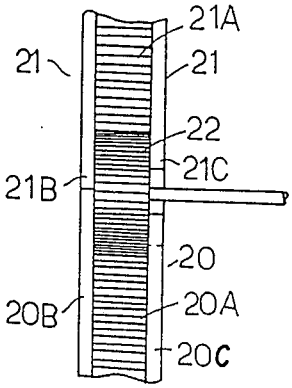

A further disc-like supporting member 18 is provided in the middle part of the cylindrical rotatable member 4. This supporting member 18 comprises a ring bearing, i.e., an outer ring member 19 composed of an outer ring 19A internally fitted to the cylindrical rotatable member 4, a plurality of balls 19B and an inner ring 19C; an eccentric disc 20 of small diameter which is eccentrically fixed onto the center shaft 6 from outside; another eccentric disc 21 of large diameter which is rotatably fitted on the eccentric disc 20 of small diameter from outside; and a planetary gear 22 to be mated with tooth spaces 20A, 21A respectively formed on the facing surfaces of the two eccentric discs 20, 21. As illustrated in FIG. 4 and FIG. 5, two lines of guide walls 20B, 20C, 21B, 21C located on both sides are formed respectively in the external surface and internal surface of the two eccentric discs 20, 21, and the tooth spaces 20A, 21A are located among the guide walls 20B, 20C, 21B, 21C by which the planetary gear 22 is guided from both sides.

A control rod 23 is connected to the planetary gear 22. The control rod 23 is inserted through a semicircular guide hole 11D and one of the side plates 9 as illustrated in FIG. 3, and supported on a bearing 24 on the outside of the cylindrical rotatable member 4. The bearing 24 is provided with a change-over mechanism which performs changeover between turning of the planetary gear 22 and stopping thereof. A turning handle 25 is attached to the end of the control rod 23.

The squeezing device of above construction performs a function described hereinafter.

First the operation of the disc-like supporting member 18 is described referring to FIG. 6 to FIG. 11 in which the outer ring member 19 is not illustrated for the sake of simplification of the drawings.

Figure 6:
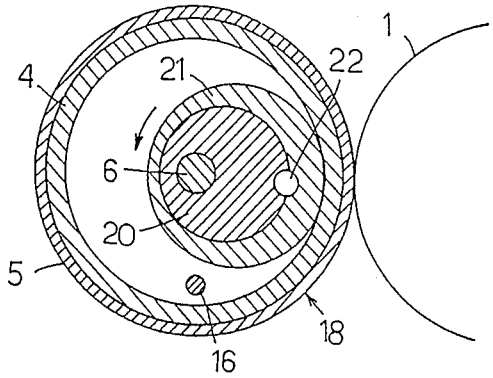
Figure 7:
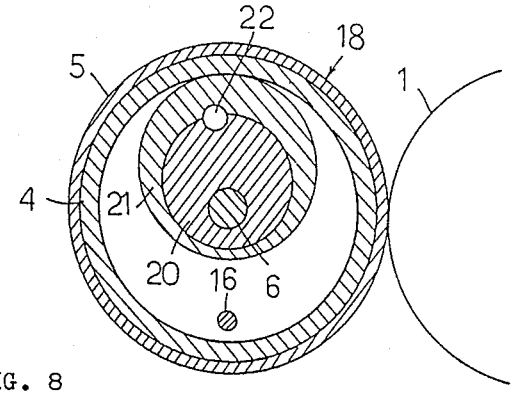
Figure 8:
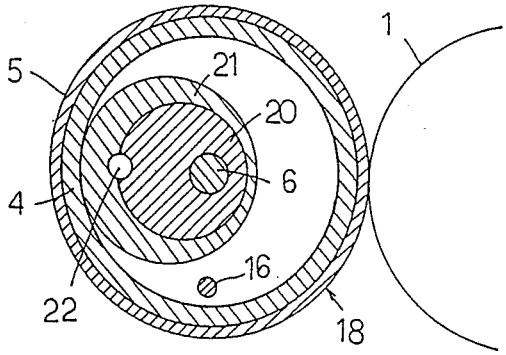

When a part of the eccentric disc 21 of large diameter is in contact with the cylindrical rotatable member 4 through the outer ring member 18 as illustrated in FIG. 6, turning of the planetary gear 22 is stopped through the control rod 23 by the change-over mechanism of the bearing 24. When the center shaft 6 is turned by 90° from the position illustrated in FIG. 6 in the direction of the arrow in FIG. 6, then the eccentric disc 20 of small diameter turns together with the center shaft 6 as illustrated in FIG. 7, and the eccentric disc 21 of large diameter also turns together by 90° through the planetary gear 22 in a stationary state. Accordingly, a contact position of the eccentric disc 21 of larger diameter with the outer ring member 19 is moved upward from a position facing to the driving squeezing extractor 1, and a gap is produced between the eccentric disc 21 of larger diameter at the position facing to the driving squeezing extractor 1. When the center shaft 6 is further turned by 90° from the position in FIG. 7, the two eccentric discs 20, 21 are turned together through the planetary gear 22 as illustrated in FIG. 8, and the gap between the eccentric disc 21 of large diameter and the outer ring 19 member at the position facing to the driving squeezing extractor 1 is enlarged.

Figure 9:
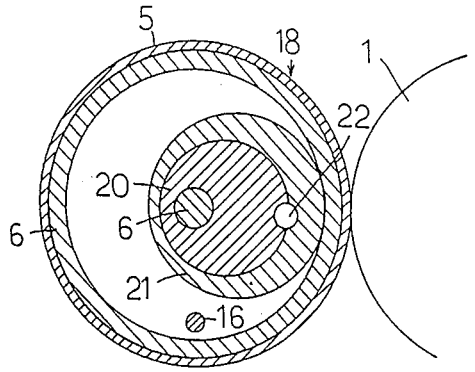
Figure 10:
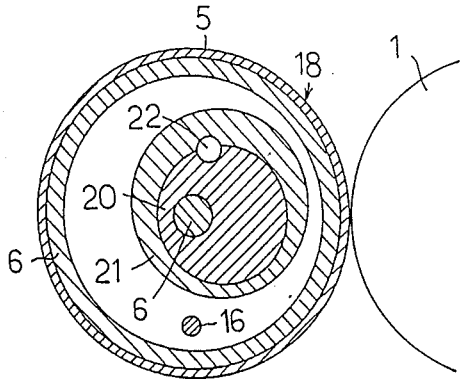
Figure 11:
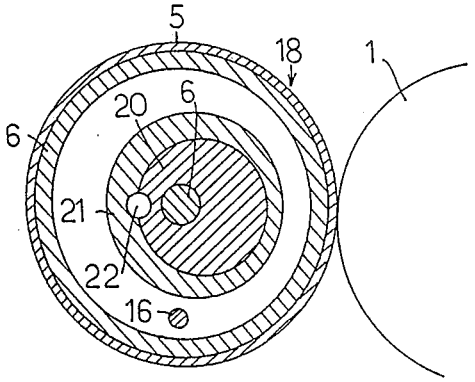

When the planetary gear 22 is changed over to be freely rotatable by the change-over mechanism of the bearing 24 and started turning from the state in FIG. 9 through the control rod 23 by operating the handle 25, the eccentric disc 20 of small diameter being mated with the center shaft 6 does not turn. Instead, the eccentric disc 21 of large diameter is turned sliding on the eccentric disc 20 of small diameter by the turning movement of the planetary gear 22. As illustrated in FIG. 10, when the planetary gear 22 has turned by 90°, a small gap is produced between the eccentric disc 21 of large diameter and the outer ring member 19. Then, as illustrated in FIG. 11, when the planetary gear 22 has turned by 180°, the gap is enlarged. The gap produced between the eccentric disc 21 of large diameter and the outer ring member 19 as the result of the turning movement of the planetary gear 22 within a range of 180° is smaller than the gap produced when turning the center shaft 6 by 180° as illustrated in FIG. 6 to FIG. 8.

Figure 12:
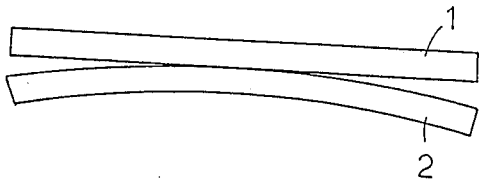
FIG. 12 and FIG. 13 are plan views respectively illustrating a state of deflection of the driven squeezing extractor with respect to the driving squeezing extractor.

Thus, in the event that a deflection takes place in a direction of strongly pressing the middle portion of the driven squeezing extractor 3 against the driving squeezing extractor 1 as illustrated in FIG. 12, the threaded rod 16 is turned by the handle 17 so that the two supporting members 10, 11 on both sides move away from each other toward both ends of the cylindrical rotatable member 4 and support the ends from inside toward the driving squeezing extractor 1. Meanwhile, the supporting member 18 in the middle portion is controlled by turning the center shaft 6 or the planetary gear 22 so as to produce a gap between the eccentric disc 21 of large diameter and the outer ring member 19 as illustrated in FIGS. 7, 8 and 10, 11. The gap produced can be adjusted corresponding to the extent of deflection of the driven squeezing extractor 3. As a result of these operations, a force acts on the middle portion of the driven squeezing extractor 3 so as to move away from the driving squeezing extractor 1, and the driven squeezing extractor 3 can act evenly on the driving squeezing extractor 1 without deflection.

Figure 13:
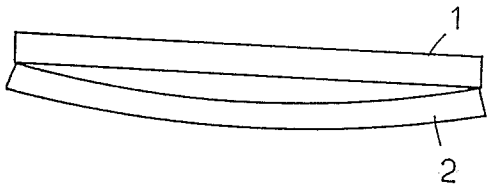

On the other hand, in the event that a deflection takes place in a direction of moving the middle portion of the driven squeezing extractor 3 away from the driving squeezing extractor 1 as illustrated in FIG. 13, the supporting members 10, 11 on both sides are moved to near the middle part, and the supporting member 18 is brought into contact with the outer ring member 19 at the position where the eccentric disc 21 of large diameter faces to the driving squeezing extractor 1 as illustrated in FIG. 6 and FIG. 9. In this manner, a force toward the driving squeezing extractor 1 acts on the middle portion of the cylindrical rotatable member 4 by the three supporting members 10, 11, 18, thereby the deflection being corrected.

The squeezing device of the invention is constructed as has been described so far, but the scope of the invention is not limited to the foregoing description and the drawings, and various changes and modifications can be made without departing from the spirit of the invention. For instance, the number of the disc-like supporting members is not necessarily limited to three located on both sides and in the middle part, but two of them may be located on both sides only or four of them may be located in parallel in the axial direction.

What is claimed is:

1. A squeezing device comprising a driving squeezing extractor and a driven squeezing extractor which comes rotationally in contact with the driving squeezing extractor to carry out a squeezing process on a fabric to be dyed, by feeding of the fabric between the two squeezing extractors, wherein:

said driven squeezing extractor comprises a hollow cylindrical rotatable member which is rotatably supported on a center shaft inserted therethrough along the axis of the cylindrical rotatable member, and at least one pair of outer disc-like supporting members arranged inside the cylindrical rotatable member to be respectively located at least at both ends in the axial direction of said cylindrical rotatable member, each of said disc-like supporting members being rotatably fitted to make forcible contact with an inner periphery of said cylindrical rotatable member and each being movable relative to said center shaft in the axial direction thereof between a corresponding end of the cylindrical rotatable member and a central portion thereof.

2. The squeezing device according to claim 1, wherein: said central portion of said cylindrical rotatable member is provided with an inner disk-like supporting member, said inner disc-like supporting member comprising an outer ring member rotatably fitted with the inner periphery of said cylindrical rotatable member, and an eccentric member which turns together with the shaft so that a position contacting a part of said outer ring member is displaced and which is freely movable to and from the outer ring member.

3. The squeezing device according to claim 2, wherein: said inner supporting member in the internal middle part of the cylindrical rotatable member comprises an outer ring member composed of an annular bearing internally fitted to the cylindrical rotatable member, an eccentric disc of small diameter which is eccentrically and rotatably fitted with the center shaft from outside, an eccentric disc of large diameter which is rotatably fitted on the eccentric disc of small diameter from outside and a part of which contacts an inner ring of said outer ring member and a planetary gear which mates with tooth spaces respectively formed on the facing surfaces of the two eccentric discs and turns to change a relative position of said two eccentric discs thereby making said eccentric disc of large diameter freely movable to and from said inner ring.

* * * * *